US008678554B2

(12) United States Patent
Inoue et al.

(10) Patent No.: US 8,678,554 B2
(45) Date of Patent: Mar. 25, 2014

(54) LIQUID DISCHARGE HEAD SUBSTRATE

(75) Inventors: Tomoyuki Inoue, Tokyo (JP); Toru Yamane, Yokohama (JP); Eisuke Nishitani, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/354,270

(22) Filed: Jan. 19, 2012

(65) Prior Publication Data

US 2012/0188310 A1 Jul. 26, 2012

(30) Foreign Application Priority Data

Jan. 21, 2011 (JP) ..... 2011-011152

(51) Int. Cl.
*B41J 2/16* (2006.01)

(52) U.S. Cl.
USPC ..... 347/50

(58) Field of Classification Search
USPC ..... 347/50
See application file for complete search history.

(56) References Cited

U.S. PATENT DOCUMENTS

| | | | | | |
|---|---|---|---|---|---|
| 4,789,425 | A * | 12/1988 | Drake et al. | ..... | 216/27 |
| 6,039,436 | A * | 3/2000 | Andrews et al. | ..... | 347/62 |
| 6,149,265 | A * | 11/2000 | Watanabe | ..... | 347/58 |
| 7,629,990 | B2 * | 12/2009 | Nishi | ..... | 347/208 |
| 2005/0001881 | A1 * | 1/2005 | Nakashima et al. | ..... | 347/50 |
| 2005/0212861 | A1 * | 9/2005 | Tsuchii et al. | ..... | 347/64 |
| 2006/0232627 | A1 * | 10/2006 | King et al. | ..... | 347/50 |
| 2008/0143789 | A1 * | 6/2008 | Takeuchi et al. | ..... | 347/58 |
| 2008/0246818 | A1 * | 10/2008 | Silverbrook | ..... | 347/56 |

FOREIGN PATENT DOCUMENTS

JP 11-070658 A 3/1999

* cited by examiner

*Primary Examiner* — Matthew Luu
*Assistant Examiner* — Alexander D Shenderov
(74) *Attorney, Agent, or Firm* — Canon USA Inc IP Division

(57) ABSTRACT

In a liquid discharge head substrate having a connection line connected to a plurality of energy generating elements, and arranged between adjacent energy generating elements, a distance between the adjacent energy generating elements, between which the connection line is not arranged, is provided to be narrower than a distance of a portion where the connection line is provided.

8 Claims, 6 Drawing Sheets

LIQUID DISCHARGE HEAD SUBSTRATE

BACKGROUND OF THE INVENTION

1. Field of the Invention

The present invention relates to a liquid discharge head substrate that discharges liquid used to perform recording operation.

2. Description of the Related Art

A liquid discharge apparatus typified by an inkjet recording apparatus performs a recording operation such that thermal energy which energy generating elements generate by performing energization is conveyed to liquid, and the liquid is discharged from discharge ports. Japanese Patent Application Laid-Open No. 11-070658 discusses a configuration for arranging a plurality of energy generating elements 108, which is connected to one connection line 109, in the high density. FIG. 5 illustrates a line layout of a liquid discharge head substrate discussed in Japanese Patent Application Laid-Open No. 11-070658. In a region between the plurality of energy generating elements 108 provided in the liquid discharge head substrate 150, there is provided the connection line 109 to which one ends of the plurality of energy generating elements 108 are connected in common, and each individual lines 102 are provided at the other ends thereof. Furthermore, the connection line 109 and the individual lines 102 are provided so that positions of the energy generating elements 108 are to be equal.

In recent years, to realize recording of high-definition images at high speeds in such a liquid discharge apparatus, there has been a demand for arranging the energy generating elements, which generate thermal energy utilized for discharging liquid, in the high density.

When an attempt is made to arrange the energy generating elements 108 in the high density of 1200 dpi or more as discussed in Japanese Patent Application Laid-Open No. 11-070658, it is necessary to provide a spacing (also referred to as a pitch) between adjacent energy generating elements of about 21 μm. In this case it is necessary to secure a certain amount of distance or more between an individual line 102*a* of an energy generating element 108*a* adjacent to the connection line 109 and the connection line 109, to secure electrical reliability. For this reason, when an attempt is made to arrange the energy generating elements 108 in the high density and equally, it is necessary to narrow a width itself of the energy generating elements.

Since the heat is absorbed by an insulating layer at an outer peripheral portion of the energy generating element, a region excluding a certain amount of outer peripheral width of the energy generating element constitutes an effective bubbling region. For this reason, when an attempt is made to provide the effective bubbling region with an equal area, while keeping the width of one side of the energy generating element narrow and keeping an aspect ratio large, it is necessary to make the width of the other side of the heating element long. Such a liquid discharge head not only invites increase in a chip area, but also is necessary to increase energy amount required to energize the energy generating element.

SUMMARY OF THE INVENTION

According to an aspect of the present invention, a liquid discharge head substrate includes an element array provided by arraying a plurality of energy generating elements which generates energy for discharging liquid by energizing, a plurality of connection lines for energizing the plurality of energy generating elements, each of the connection lines being connected to the two or more energy generating elements, and being provided in a region between the adjacent energy generating elements. A spacing between adjacent energy generating elements between which the connection line is provided is wider than a spacing between adjacent energy generating elements, between which the connection line is not provided.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 6A:
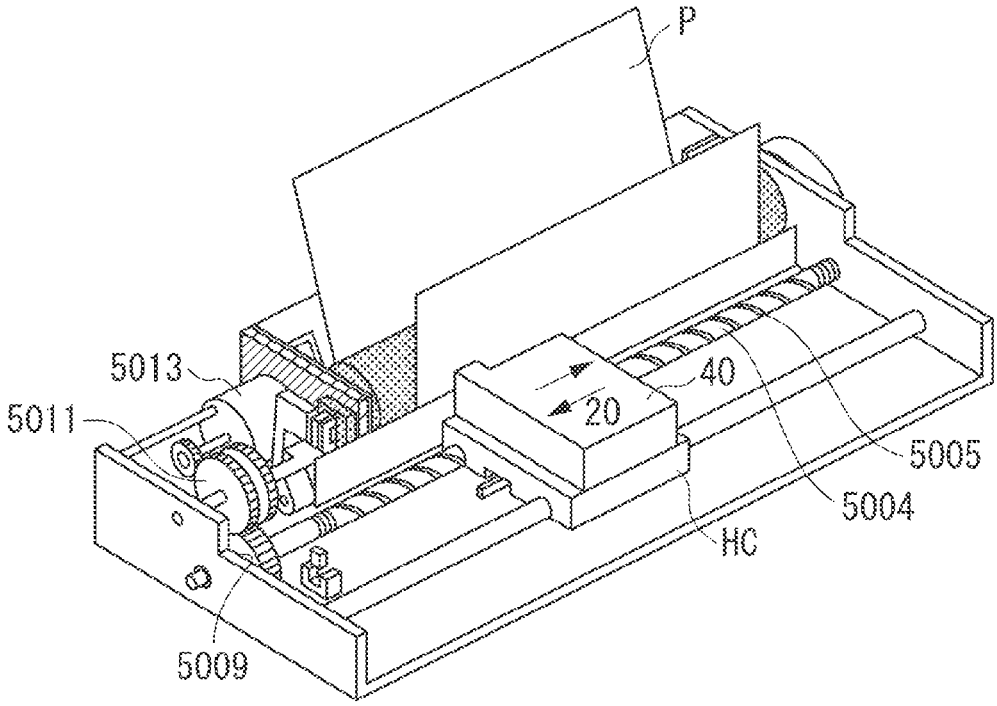
FIGS. 6A and 6B are perspective views schematically illustrating a liquid discharge apparatus and a head unit according to the present invention.

A liquid discharge apparatus will be described. FIG. 6A is a schematic view illustrating a liquid discharge apparatus that can mount thereon a liquid discharge head according to the present invention. As illustrated in FIG. 6A, a lead screw 5004 rotates in conjunction with forward reverse rotation of a driving motor 5013 via driving force transmission gears 5011 and 5009. A carriage HC can place and hold a head unit thereon, and has a pin (not illustrated) engaged with a screw groove 5005 of the lead screw 5004, and scanning is performed in a direction of an arrow 20 by the rotation of the lead screw 5004. A head unit 40 is mounted on the carriage HC. The liquid discharge apparatus according to the present invention can perform a recording operation on a recording medium P such as paper in a single scanning.

Figure 6B:
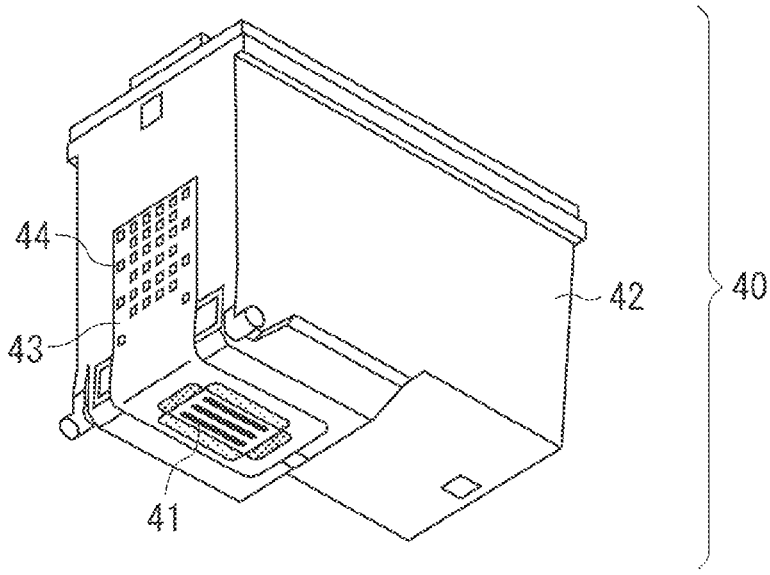

The head unit will be described. FIG. 6B is a perspective view of the head unit 40 that is mountable on the liquid discharge apparatus such as the one illustrated in FIG. 6A. A liquid discharge head 41 (hereinafter, also referred to as a head) is conducting to a contact pad 44, which is connected to the liquid discharge unit, via a flexible film wiring substrate 43. Further, the head 41 is integrally joined with an ink tank 42 to constitute the head unit 40. Although the head unit 40 illustrated in FIG. 6B is, as an example, integration of the head 41 and the ink tank 42, the head unit 40 may be a separation type in which the ink tank 42 can be separated from the head 41.

Figure 1A:
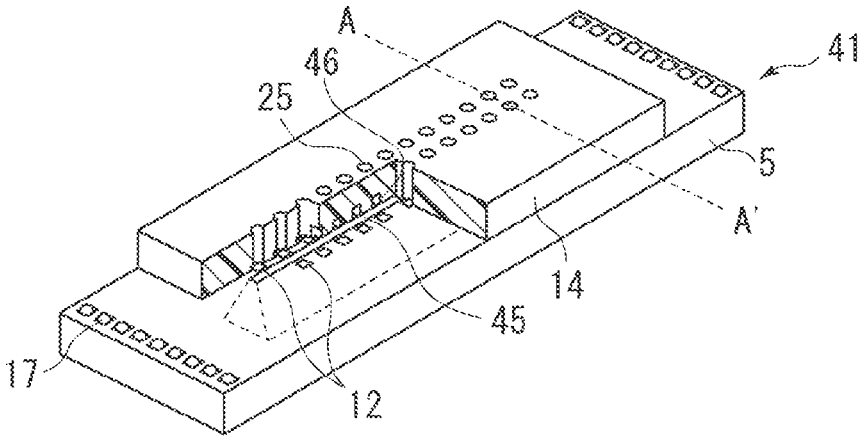
FIGS. 1A and 1B are perspective views schematically illustrating a liquid discharge head according to the present invention.
Figure 1B:
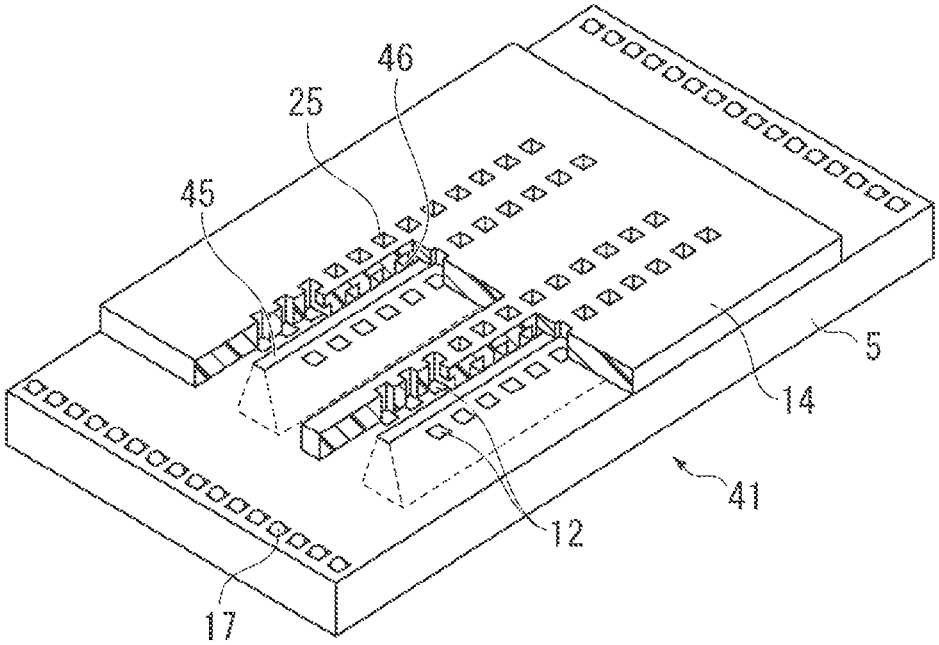

The liquid discharge head will be described. FIGS. 1A and 1B illustrate perspective views of the liquid discharge heads 41 to which the present invention can be applied. Herein, descriptions will be given using the liquid discharge head 41 provided with an element array configured such that a plurality of energy generating elements 12 is arrayed in a density of 1200 dpi, namely, at about 21 μm pitch. The liquid discharge head 41 according to the present invention has the liquid discharge head substrate 5 provided with the energy generating elements 12 and an insulating layer (not illustrated) for protecting the energy generating elements 12 from the liquid, on a silicon substrate, and a flow path member 14 provided on the liquid discharge head substrate 5. The flow path member 14 has discharge ports 25 through which liquid is discharged by energy generated by the energy generating elements 12, and a concave portion which serves as a part of a flow path 46 that communicates with the discharge ports 25. The flow path member 14 contacts with the liquid discharge head substrate 5, with the concave portion being arranged on the inside, thereby constituting the flow path 46.

Furthermore, the liquid discharge head 41 has a supply port 45, which is provided by penetrating through the liquid discharge head substrate 5, for sending the liquid to the flow path 46, and terminal portions 17 that perform electrical connection with the outside. The discharge ports 25 provided in the flow path member 14 form a discharge port array in which discharge ports 25 are arrayed at predetermined pitches, and two arrays are provided on both sides along a longitudinal direction of the supply port 45 in a rectangular shape. The liquid supplied from the supply port 45 is conveyed to the flow path 46, and is discharged from the discharge ports 25 by energy generated by applying voltage from the outside supplied from the connection terminals 17 to the energy generating elements 12 via an electrical line (not illustrated), and recording operation is performed.

The liquid discharge head 41 can use not only one supply port as illustrated in FIG. 1A, but also a plurality of supply ports 45 as illustrated in FIG. 1B to supply the same kind of liquid.

The term "liquid recording apparatus" in the present specification indicates a printer, a copying machine, a facsimile having a communication system, a word processor having a printer section, and other apparatuses, furthermore, complexly combined industrial recording apparatuses with various types of processing apparatuses. By using the liquid discharge head, recording can be performed on various recording media such as paper, string, fiber, cloth, leather, metal, plastic, glass, wood, and ceramic. The term "recording" means not only applying an image which has a meaning such as characters or graphics to a recording medium, but also applying an image such as a pattern which has no meaning.

Further, the term "liquid" should be widely interpreted, and refers to liquid served, by being applied on a recording medium, for formation of image, design and pattern, manufacturing of recording medium, or processing of ink or recording medium. Processing of the ink or the recording medium refers to, for example, enhancement of fixability by solidification or insolubilization of color material contained in the ink applied to the recording medium, enhancement of recording quality or coloring property, and enhancement of image durability.

A first exemplary embodiment will be described. The present exemplary embodiment uses electrothermal conversion elements (heating elements) as the energy generating elements 12. The liquid is caused film-boiling by thermal energy generated by the heating elements 12, and the liquid is discharged from the discharge ports 25 by the pressure of the film-boiling, thereby recording operation is carried out.

Figure 2A:
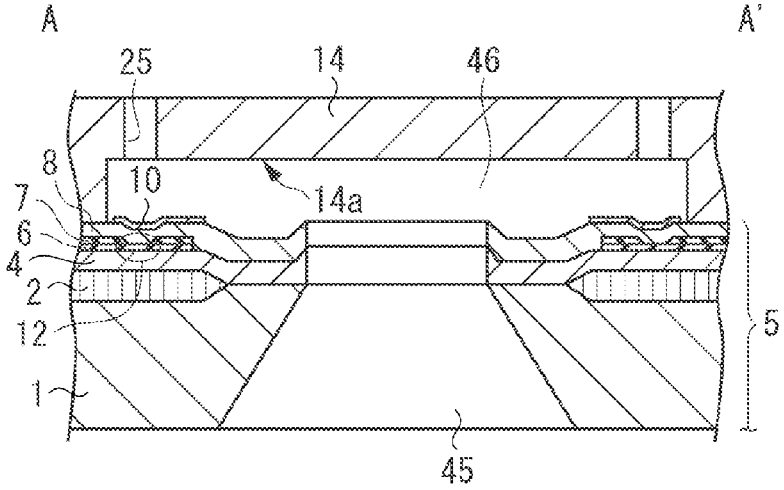
FIGS. 2A and 2B are top views of the liquid discharge head illustrated in a first exemplary embodiment.
Figure 2B:
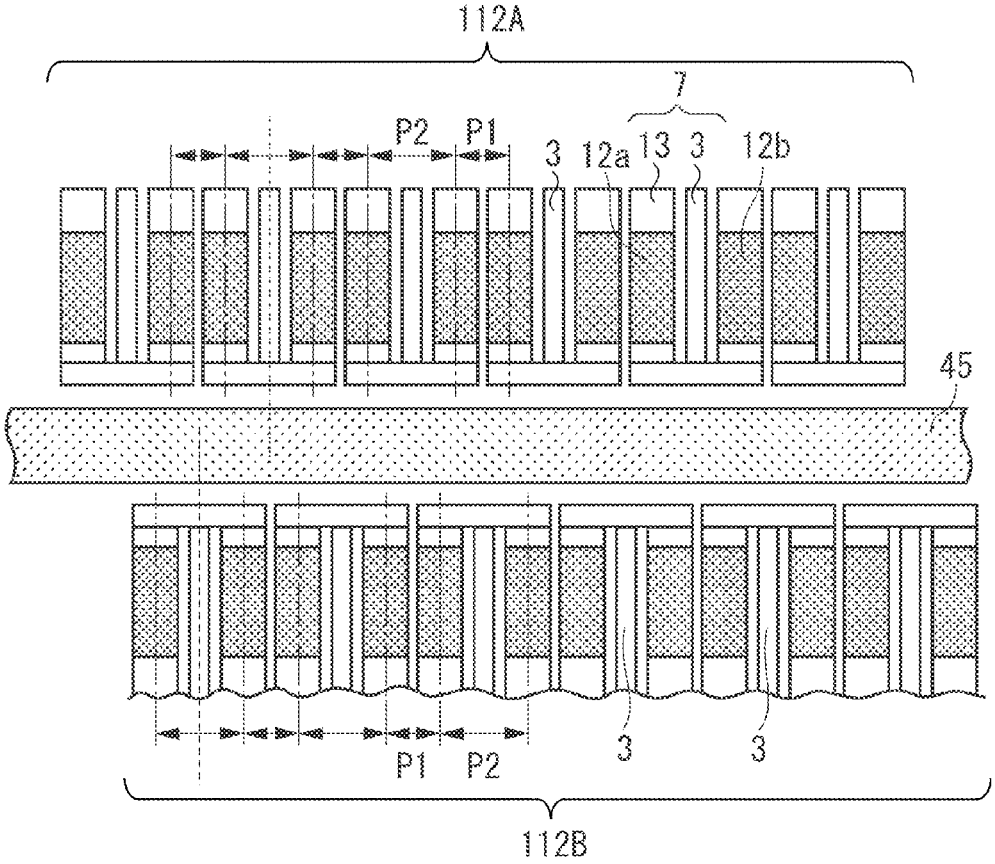

Next, a layer configuration of the liquid discharge head substrate 5 will be described. FIGS. 2A and 2B schematically illustrate a state of cut surface in a case where the liquid discharge head 41 is cut perpendicular to the liquid discharge head substrate 5 along a line A-A' in FIG. 1A. On a silicon substrate 1 provided with a driving element (not illustrated) such as a transistor, a thermal oxide layer 2 provided by heat-oxidizing a part of the substrate 1, and a heat accumulation layer 4 composed of a silicon compound are provided. A heating resistance layer 6 made of material (e.g., TaSiN or WSiN) which generates heat by being energized is provided on the heat accumulation layer 4, and a pair of lines 7 made of aluminum-based material or the like with a lower resistance than that of the heating resistance layer 6 is provided, so as to contact with the heating resistance layer 6. By applying voltage between the pair of lines 7, and causing a portion of the heating resistance layer 6 positioned between the pair of lines 7 to generate heat by performing energization, a portion of the heating resistance layer 6 positioned therebetween is used as the heating elements 12. The heating resistance layer 6 and the pair of lines 7 are covered with an insulating layer 8 made of an insulative material such as silicon compound including SiN, to achieve insulation from a liquid such as an ink to be used for discharge. Furthermore, to protect the heating elements 12 from cavitation shock or the like associated with bubbling, contraction of the liquid for discharge, the protecting layer 10 used as a cavitation-resistant layer can be provided on the insulating layer 8 corresponding to a portion of the heating elements 12. More specifically, metallic material such as tantalum can be used as the protecting layer 10. Furthermore, the flow path member 14 is provided on the insulating layer 8. To enhance close-contact property between the insulating layer 8 and the flow path member 14, an adhesive layer made of polyether-amide resin or the like can be provided between the insulating layer 8 and the flow path member 14. The discharge ports 25 are provided at positioned opposed to the heating elements 12. Recording operation is performed by causing the liquid of the flow path 46 to be film-boiled and discharging the liquid from the discharge ports 25 by the use of thermal energy generated by driving the heating elements 12.

FIG. 2B illustrates a top view schematically representing the heating elements 12 and the pair of lines 7 of the liquid discharge head 41 as illustrated in FIG. 1A.

The one of the pair of lines 7 is connected to one end of the heating element 12, and furthermore a plurality of the others of the pair of lines 7 is connected in common to one connection line 3, and the connection line is provided extending in a opposite direction of the supply port 45. The individual line 13 which is the other of the pair of lines 7 is provided to be connected to the other ends of the respective heating elements 12, and is provided extending in a opposite direction of the supply port 45.

The individual lines 13 are connected in common with a grounding line (not illustrated: hereinafter, referred to as a GNDH line) for supplying grounding potential via a driving element (not illustrated) such as a Metal-Oxide-Semiconductor Field-Effect Transistor (MOS-FET) used to control ON/OFF of the heating element 12. Further, the connection line 3 is connected in common to a power supply line (not illustrated: hereinafter, a VH line) for supplying power-source potential. Furthermore, the VH line and the GNDH line are connected to either of the terminals 17 of the liquid discharge head substrate 5, and are connected to a recording apparatus or the like via the terminal 17. The heating element 12 can be driven by applying potential difference between the VH line and the GND line, thereby causing electric current to flow through the heating elements 12.

Hereinafter, a case where the connection line 3 is connected to two heating elements 12 will be described. The connection line 3 connected to the one of the pair of lines corresponding to a first heating element 12*a* and a second heating element 12*b* adjacent to each other, passes through a region between the first heating element 12*a* and the second heating element 12*b*, and is provided extending to the side opposite to the supply port 45. Hereinafter, the two heating elements 12 connected to one connection line 3 are called one element group. An element array is provided such that a plurality of the element groups is arrayed. In an area where the connection line 3 passes between the adjacent heating elements, a distance between the centers of gravity of the adjacent heating elements, is denoted as P2. Furthermore, when a distance between centers of gravity of the adjacent heating elements, in an area where the connection line does not pass between the adjacent heating elements, is denoted as P1, the adjacent heating elements are provided to hold a relationship of P2>P1. While keeping P2>P1, by narrowing a spacing between the centers of gravity of the adjacent heating elements, between which the connection line does not pass, the heating elements can be arranged in the high density, without decreasing a width of the heating elements.

Furthermore, as illustrated in FIG. 2B, the element arrays are configured such that two arrays of a first element array 1 1 2 A and a second element array 1 1 2 B to be used for recording operation of the same kind of liquid are provided in parallel, across the supply port 45. The connection lines 3*a* of the first element array 1 1 2 A are provided to be positioned between adjacent connection lines 3 of the second element array 1 1 2 B. In other words, with respect to a vertical direction orthogonal to a longitudinal direction of the supply port 45, a region of the element group which belongs to the first element array 1 1 2 A is provided to be displaced by ½ pitch with a region of the element group which belongs to the second element array 1 1 2 B. In this way, the element groups are provided so as to be displaced with each other. Thereby, even if the heating elements are unequally arranged such as P2>P1, they can be offset with each other, and can provide recording images without affecting the recording operation.

Next, the effects of the present invention will be specifically described, in comparison with a case in which the width of the heating elements is narrowed. To realize element density of 1200 dpi of a plurality of heating elements, the elements must be arranged at an arrangement pitch of about 21 μm. However, to secure reliability in manufacturing process such as photolithography technology, or an electrical reliability between adjacent lines, it is considered that keeping a certain distance or more between lines is needed.

P is an arrangement pitch of heating elements in rectangular shape, W is a length with respect to long side direction of supply port of heating elements, L is a length with respect to short side direction of supply port of heating elements, DL is a line width, DS is a spacing between heating elements and lines. On the precondition that the heating elements are equally arranged since a minimum width of DS is determined as described above, it becomes necessary to provide the heating elements so as to satisfy the formula of $W=P-(DL+DS\times 2)$.

Further, to obtain discharge performance of being able to discharge a desired amount of liquid droplets at a stable speed by using the heating elements, it is necessary to secure an effective bubbling region which contributes to the occurrence of film-boiling phenomenon by rapidly heating the liquid. "Effective bubbling region" refers to an area obtained by subtracting an area of an outer peripheral portion where temperature enough to sufficiently film-boil the liquid is not reached even when the elements are driven from an area of heating elements where heat is generated by being actually energized.

Figure 3A:
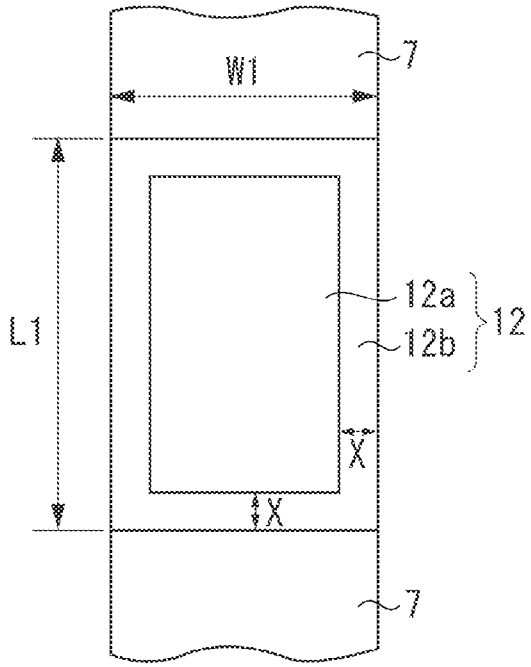
FIGS. 3A and 3B are schematic views of liquid discharged by using the liquid discharge head illustrated in the first exemplary embodiment.
Figure 3B:
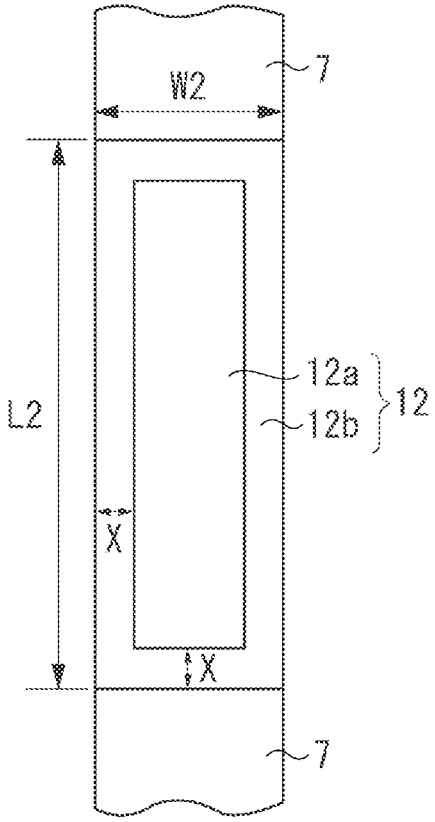

With respect to the heating elements in rectangular shape, FIG. 3A illustrates a schematic view of a heating element with a small aspect ratio (L1/W1). FIG. 3B illustrates a schematic view of a heating element with a relatively large aspect ratio (L2/W2). The heating resistance layers of the heating elements illustrated in FIGS. 3A and 3B are both connected to a pair of electrodes. Via the pair of electrodes, electric current flows through the heating resistance layer, thereby heat is generated and used for the recording operation. Of the heat generated by such a heating resistance layer, all heat is not used for the recording operation, but a part of the heat will be absorbed by the insulating layer. For this reason, the effective bubbling region 12*a* (the first region) of the heating element is situated a certain width (X μm) inside the outer periphery of the heating element. In other words, the effective bubbling region which contributes to discharge of the liquid is provided to be surrounded by the second region 12*b* which does not contribute to the discharge of the liquid. A width X of the second region which is not used for such a bubbling is a virtually constant width. As a result, in a case where an aspect ratio is large, an area of the heating element necessary for securing the same effective area becomes large.

Therefore, to satisfy the formula of $W=P-(DL+DS\times 2)$ while securing the effective bubbling region, it becomes necessary to provide the heating element with a large aspect ratio. An area of the heating element will be considered in a case where, for example, an effective heating element area of 200 square μm is required, with a width X of 2 μm of the outer peripheral portion which does not contribute to bubbling of the liquid. In comparison with an aspect ratio 1 (L1/W1=1), it is necessary to increase areas of the heating element by about 4% for an aspect ratio 2 (L1/W1=2), by about 9% for an aspect ratio 3 (L1/W1=3), and by 15% for an aspect ratio 4 (L1/W1=4), respectively.

Further, along with the increase of an area of the heating element in this manner, a region of the heating element which is not used for bubbling becomes larger and required energy amount becomes much more. On the other hand, by unequally arranging a spacing of the heating elements such as P2>P1 daringly, there is no need to narrow the area of the heating element to attain 1200 dpi. As a result, it becomes possible to effectively make use of a region between the heating elements where the connection line is not provided. In other words, effective bubbling region can be secured by widening a width in a direction along the element array of the heating elements while achieving higher density, and recording operation can be performed efficiently without the need to increase L of the heating element with respect to a short side direction of the supply port.

Furthermore, the connection line corresponding to the second element array 1 1 2 B is provided to be displaced by ½ pitch, relative to the connection line corresponding to the first element array 1 1 2 A, thereby recording operation with such a high reliability that no streaks/unevenness of recorded images would occur can be performed in a single scanning.

In the present exemplary embodiment, descriptions have been given using an example in which the connection line 3 is positioned between the first heating element and the second heating element, but the connection line 3 may pass between adjacent element groups.

A second exemplary embodiment will be described. The head illustrated in the present exemplary embodiment relates to the liquid discharge head having two arrays of the supply ports used for supplying the same kind of liquid such as the one illustrated in FIG. 1B. On both sides along long sides of the supply ports, a first element array, a second element array, a third element array and a fourth element array are provided in parallel. The layer configuration of the head and recording operation using the VH line and the GND line are similar to those in the first exemplary embodiment, and descriptions thereof will not be repeated.

Figure 4A:
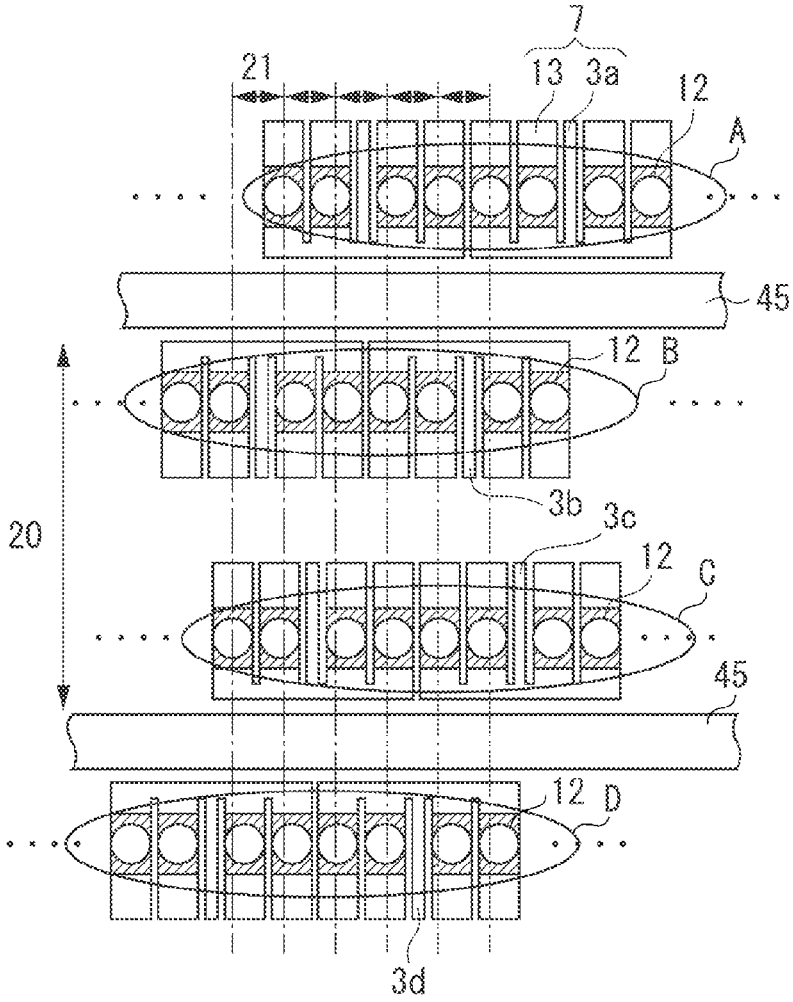
FIGS. 4A and 4B are top views of a liquid discharge head illustrated in a second exemplary embodiment.

FIG. 4A illustrates a top view schematically representing the supply ports 45 and the heating elements 12 and the pair of lines 7 extracted from the liquid discharge head 41 such as the ones in FIG. 1B. Furthermore, reference characters A to D are assigned for convenience to the discharge ports opposed to the element arrays of the heating elements 12, such as a discharge port array A, a discharge port array B, a discharge port array C, and a discharge port array D.

Respective element arrays are provided with one connection line 3*a*, 3*b*, 3*c*, or 3*d* for each element group which is composed of four consecutive heating elements. The connection lines, in FIG. 4A, exhibit a configuration in which the lines are provided in the middle of the element groups, but they may pass between any heating elements or between other element groups.

As illustrated in the present exemplary embodiment, the heating elements are arranged so that a heating element spacing of a portion through which the connection line does not pass is smaller than a heating element spacing of a portion through which the connection line passes. By daring not to equalize the heating element spacings in this manner, it is possible to effectively make use of a region between the heating elements where there is no need to cause the connection line to pass therethrough. In other words, by increasing a width of the heating element in a direction along the element array while achieving a high density, effective bubbling region can be secured, and thus recording operation can be efficiently performed.

Figure 4B:
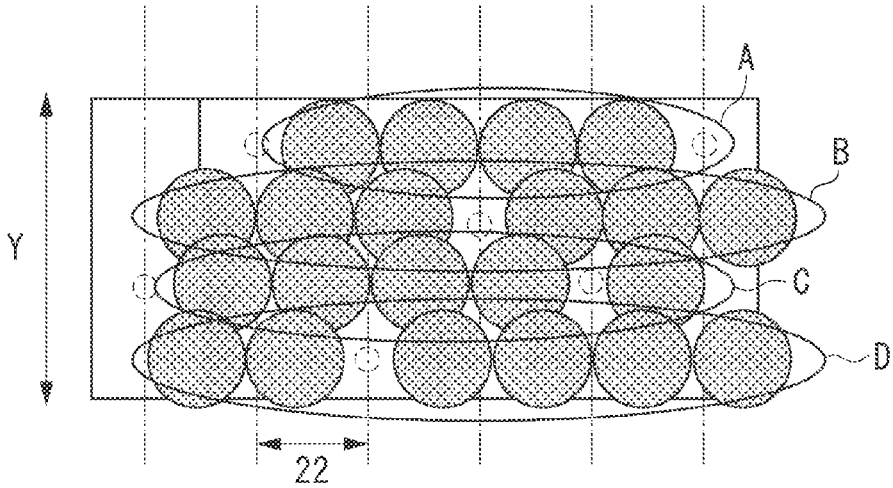
Figure 5:
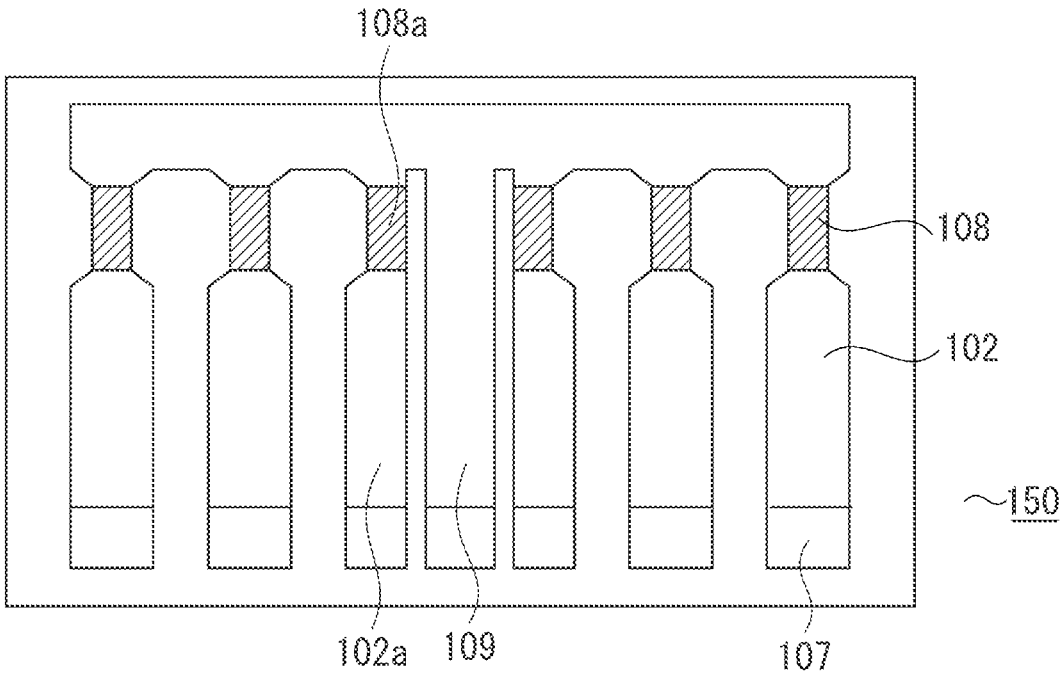
FIG. 5 is a schematic view of conventional liquid discharge head.

Furthermore, when letting a spacing of adjacent connection lines corresponding to one element array to be 1 pitch, with respect to relative movement direction 20 relative to a recording medium P illustrated in FIG. 6A, the connection lines are provided such that their positions are displaced in increments of ¼ pitch for each element array. Thereby, the positions of the heating elements of respective arrays will be displaced from each other, with respect to the relative movement direction relative to the recording medium P. A schematic arrangement of discharged liquid droplets is illustrated in FIG. 4B, in a case where the discharge port array A to D in this case discharge the liquid onto the recording medium in order, and recording operation is carried out. Since it becomes difficult to recognize a plurality of liquid droplets when overlapped, discharged liquid droplets for each element array in Y-direction in FIG. 4B are illustrated so as to be more recognizable for convenience.

The discharged liquid droplets formed by the liquid droplets discharged from the respective discharge port arrays will not be lined up in a pixel unit 22 of an equal pitch, and clearances will be formed at portions of the connection lines similarly to the discharge port arrays. However, the discharge liquid droplets formed by the liquid droplets discharged from the discharge port arrays each having different pattern of bias can cancel the bias of one by the other, and thus recording operation with high reliability without the occurrence of streaks/unevenness of recorded images can be performed in a single scanning.

In the present exemplary embodiment, the case of providing four arrays of the element arrays is used, but any number of element arrays may exist. In a configuration of, for example, eight arrays of the element arrays, consecutive eight heating elements are provided to be connected to one connection line. If the connection lines are displaced in increments of ⅛ pitch so that the connection lines of respective arrays do not coincide with each other on their extension, with respect to a short side direction of the supply port, the bias of the liquid droplets can similarly is canceled each other. In this case, by providing the heating elements so that a number of the heating elements connected to one connection line coincides with a number of the element arrays, the bias of discharge liquid droplets can be canceled each other.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2011-011152 filed Jan. 21, 2011, which is hereby incorporated by reference herein in its entirety.

What is claimed is:

1. A liquid discharge head substrate comprising:

a first element array and a second element array provided by arraying a plurality of energy generating element configured to generate energy for discharging liquid by energizing, the first element array and the second element array being provided along each other;

a plurality of connection lines configured to energize the plurality of energy generating elements, each of the connection lines being connected to two or more energy generating elements of the plurality of energy generating elements, and being provided in a region between adjacent energy generating elements, wherein a spacing between adjacent energy generating elements between which the connection line is provided is wider than a spacing between adjacent energy generating elements between which the connection line is not provided, and wherein a region between adjacent energy generating elements of the first element array, between which the connection line is not provided, is positioned so as to be overlapped with a region between adjacent energy generating elements of the second element array, between which the connection line is provided, with respect to an orthogonal to a direction in which the plurality of energy of generating elements of the element arrays is arrayed.

2. The liquid discharge head substrate according to claim 1, wherein the plurality of energy generating elements comprises:

a first region configured to generate energy used for discharge of liquid; and a second region configured to be provided at a constant width to surround outer periphery of the first region, and generate energy not used for discharge of liquid.

3. The liquid discharge head substrate according to claim 1, wherein each spacing between adjacent energy generating elements, between which the connection line is not provided, is equal.

4. The liquid discharge head substrate according to claim 1, wherein a plurality of connection lines corresponding to the first element arrays and the second element array is provided so as not to be positioned on each other's extension, with respect to orthogonal direction.

5. The liquid discharge head substrate according to claim 1, wherein a plurality of the connection lines corresponding to the first element array and a plurality of the connection lines corresponding to the second element array are provided to be alternately positioned with respect to a direction in which the plurality of energy generating elements of the element arrays are arrayed.

6. The liquid discharge head substrate according to claim 5, wherein the plurality of connection lines corresponding to the first element array is provided to be displaced by a half spacing between adjacent connection lines corresponding to the element array, relative to the plurality of connection lines corresponding to the second element array in a direction in which the plurality of energy generating elements of the element arrays are arrayed.

7. The liquid discharge head substrate according to claim 1, further comprising four element arrays including the first element array, the second element array, a third element array, and a fourth element array parallel to each other, wherein a plurality of the connection lines corresponding to the first element arrays, a plurality of the connection lines corresponding to the second element array, a plurality of connection lines corresponding to the third element array, and a plurality of the connection lines corresponding to the fourth element array are provided to be positioned in order with respect to a direction in which the plurality of energy generating elements of the element arrays are arrayed.

8. The liquid discharge head substrate according to claim 1, wherein the plurality of energy generating elements has an approximately equal area.

* * * * *